US006527593B2

(12) United States Patent
Handa et al.

(10) Patent No.: US 6,527,593 B2
(45) Date of Patent: Mar. 4, 2003

(54) MODULAR JACK AND ITS ATTACHING STRUCTURE

(75) Inventors: Shinsuke Handa, Osaka (JP); Satoru Watanabe, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/994,625

(22) Filed: Nov. 28, 2001

(65) Prior Publication Data

US 2002/0065003 A1 May 30, 2002

(30) Foreign Application Priority Data

Nov. 28, 2000 (JP) ..... 2000-361386

(51) Int. Cl.[7] ..... H01R 24/01
(52) U.S. Cl. ..... 439/676; 439/607
(58) Field of Search ..... 439/676, 344, 439/607, 660

(56) References Cited

U.S. PATENT DOCUMENTS 4,269,467 A * 5/1981 Hughes ..... 29/883
4,296,991 A * 10/1981 Hughes et al. ..... 379/442
4,629,266 A * 12/1986 Viselli ..... 439/344
4,850,902 A * 7/1989 Reed ..... 439/676
5,178,554 A * 1/1993 Siemon et al. ..... 200/51.1
5,538,448 A * 7/1996 Tsao ..... 439/676

FOREIGN PATENT DOCUMENTS

JP 7-245147 9/1995

OTHER PUBLICATIONS

D.A. Daggs, et al., Motorola Technical Developments, vol. 20, p. 24, XP–000403802, "Low Profile Surface Mount Vertical Modular Jack", Oct. 1, 1993.

* cited by examiner

*Primary Examiner*—Tulsidas Patel
(74) *Attorney, Agent, or Firm*—Oblon, Spivak, McClelland, Maier & Neustadt, P.C.

(57) ABSTRACT

A plurality of contact pins are arranged in an insertion recessed portion of a casing to align horizontally. The contact pin includes a fixed portion fixed to a fixing hole of a side wall and an elastic contact portion extended from a front end of the fixed portion in a rear direction in an inclined shape. In connecting a modular plug, a front end of the elastic contact portion is projected to the outside of the casing via a slit and invades inside of a through hole of a printed wiring board.

11 Claims, 11 Drawing Sheets

MODULAR JACK AND ITS ATTACHING STRUCTURE

BACKGROUND OF THE INVENTION

1. Field of the Invention

The present invention relates to a modular jack mounted to an apparatus such as a notebook type personal computer, a game machine or the like and mated with a modular plug corresponding thereto.

2. Description of the Related Art

A modular jack of this kind is for connecting a modular plug from a telephone network or an LAN network and is provided with a casing made of synthetic resin having an insertion recessed portion for inserting and drawing a modular plug. At inside of the insertion recessed portion, there is contained a contact pin for being brought into contact with a contact of the modular plug.

Each of the contact pins includes a fixed portion fixedly inserted into a fixing hole penetrating a side wall of the casing in a front and rear direction and an elastic contact portion bent to constitute an acute angle from a front end of the fixed portion and extended in an inclined shape toward a back face of the casing.

When the modular plug is connected to the modular jack, a contact of the modular plug is brought into press contact with an elastic contact portion of the modular jack and the elastic contact portion is elastically deformed such that an inclination angle thereof constitutes a steeper slope. Therefore, a rear end of the elastic contact portion is moved further in a rear direction. When a moving stroke of the rear end of the elastic contact portion is to be ensured, a height of the casing is increased in casing.

The constitution is opposedly against a request of a low height in a modular jack applied to an apparatus of a notebook type personal computer, a game machine or the like.

SUMMARY OF THE INVENTION

The invention has been carried out in view of the above-described problem and it is an object thereof to provide a modular jack capable of achieving a low height and its attaching structure.

In order to achieve the above-described object, according to a first aspect of the invention, there is provided a modular jack characterized in including a casing having an insulating performance for partitioning an insertion recessed portion opened in a front direction for inserting a modular plug, and a plurality of contact pins arranged in the insertion recessed portion to align horizontally, wherein each of the contact pins includes a fixed portion fixedly inserted into a fixing hole penetrating a side wall of the casing in a front and rear direction and an elastic contact portion bent to constitute an acute angle from a front end of the fixed portion and extended in an inclined shape toward a rear face of the casing, and wherein when the casing is connected to the modular plug, a front end of the elastic contact portion pressed by a contact of the modular plug is projected rearward from the casing via a lead-out opening formed at the rear face of the casing.

According to the invention, when the modular plug is connected to the modular jack, the front end of the elastic contact portion of the contact pin can be projected rearward from the casing and therefore, a moving stroke of the front end of the elastic contact portion in connecting the modular plug to the modular jack can also be ensured at the outside of the casing. As a result, by that amount, is the height of the casing can be lowered.

According to a second aspect of the invention, there is provided the modular jack according to the first aspect, characterized in that the lead-out opening includes a plurality of slits for guiding the front ends of the elastic contact portions of the respective contact pins in a direction of dislocating the front ends in bending the elastic contact portions. According to the invention, when the front end of the elastic contact portion is projected to the outside of the casing, a vicinity of the front end is guided by the slit and therefore, the elastic contact portion can smoothly be dislocated.

The invention according to a third aspect provides an attaching structure of a modular jack for attaching the modular jack according to the first or second aspect to a printed wiring board, characterized in that a surface of the printed wiring board is provided with an escapement for permitting the front end of the elastic contact portion to project from the rear face of the casing in a rear direction. By applying the modular jack according to the first or second aspect to the printed wiring board having the escapement, a low height of the modular jack is substantially enabled.

DETAILED DESCRIPTION OF THE PREFERRED EMBODIMENTS

An explanation will be given of preferable embodiments of the invention in reference to the attached drawings.

Figure 1:
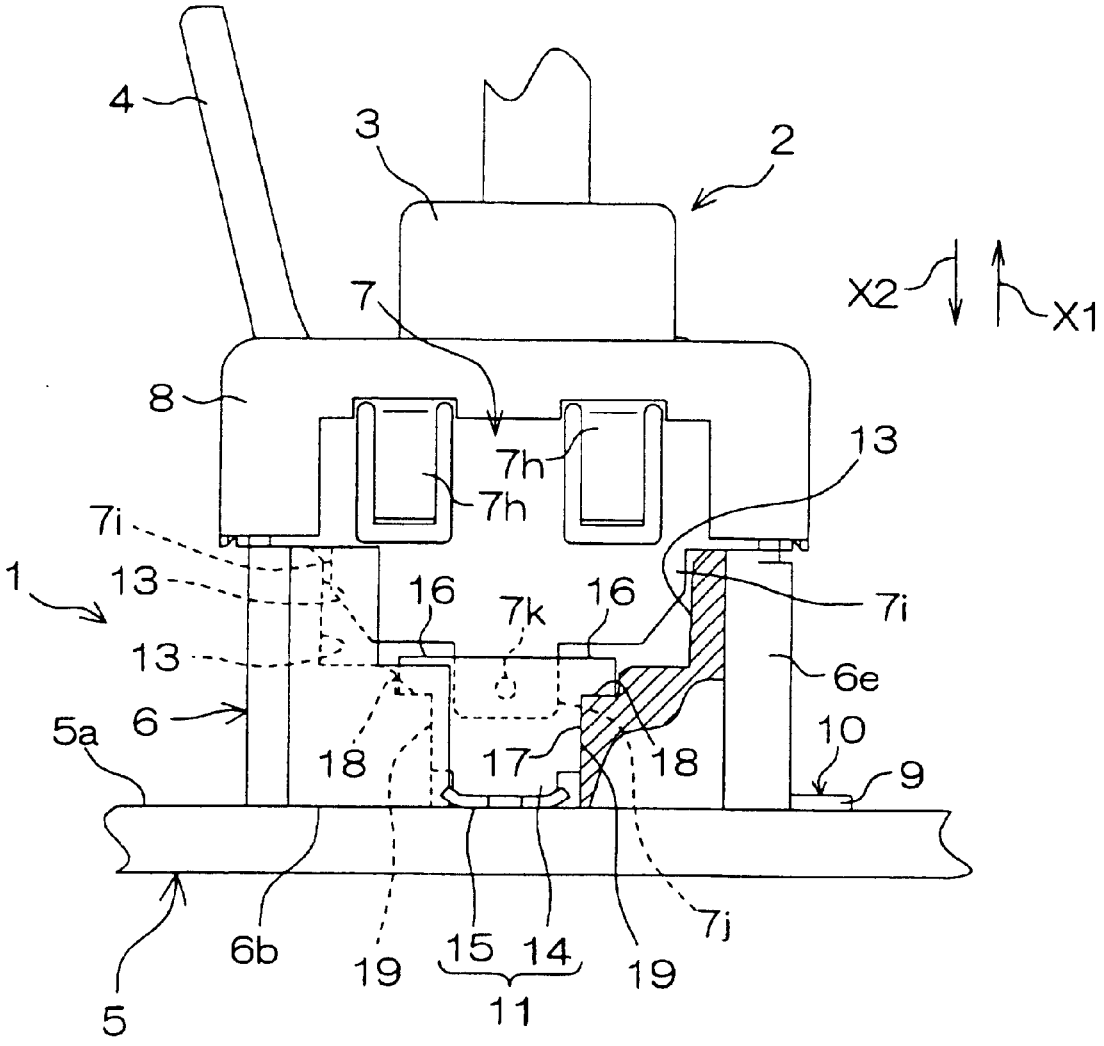
FIG. 1 is a partially broken side view showing a state of attaching a modular plug to a modular jack according to an embodiment of the invention.

FIG. 1 is an outline side view showing a state in which a modular plug is mounted to a modular jack according to an embodiment of the invention. In reference to FIG. 1, the modular jack 1 is for connecting a modular plug 2 of a standardized product. The modular plug 2 is provided with a plug main body 3 for holding a plurality of contact pins (not illustrated) and an elastically deformable engaging lever 4 supported by the plug main body 3 in a cantilever shape.

Although according to the embodiment, an explanation will be given in conformity to an example of a vertical modular jack in which a front side of the modular jack 1 constitutes an upper direction X1 and a rear side thereof constitutes a lower direction X2, the invention is not limited thereto but the invention may be applied to a horizontal modular jack in which a front side of the modular jack is directed in a horizontal direction.

The modular jack 1 is provided with a casing 6 having an insulating performance made of, for example, synthetic resin and arranged above a printed wiring board 5; a shell 7 made of a metal for electromagnetic shielding for covering at least a portion of the casing 6; an insulating cover 8 made of, for example, synthetic resin is for covering at least a portion of the shell 7; a plurality of contact pin 10 respectively having lead portions 9; and a reinforcement tab 11 soldered to a conductive portion above the printed wiring board 5 while reinforcing the casing 6.

Figure 2:
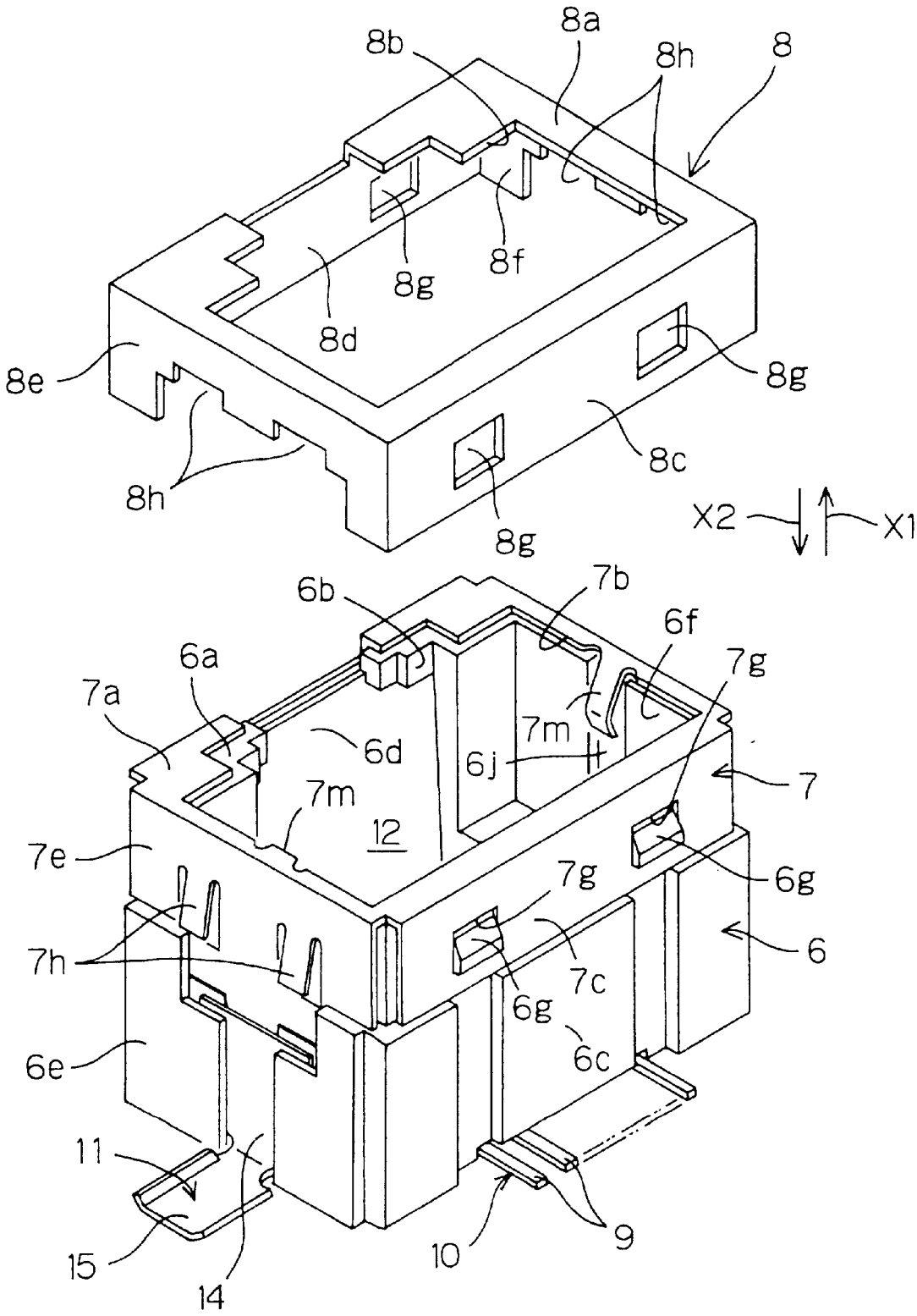
FIG. 2 is a disassembled perspective view of the modular jack.
Figure 3:
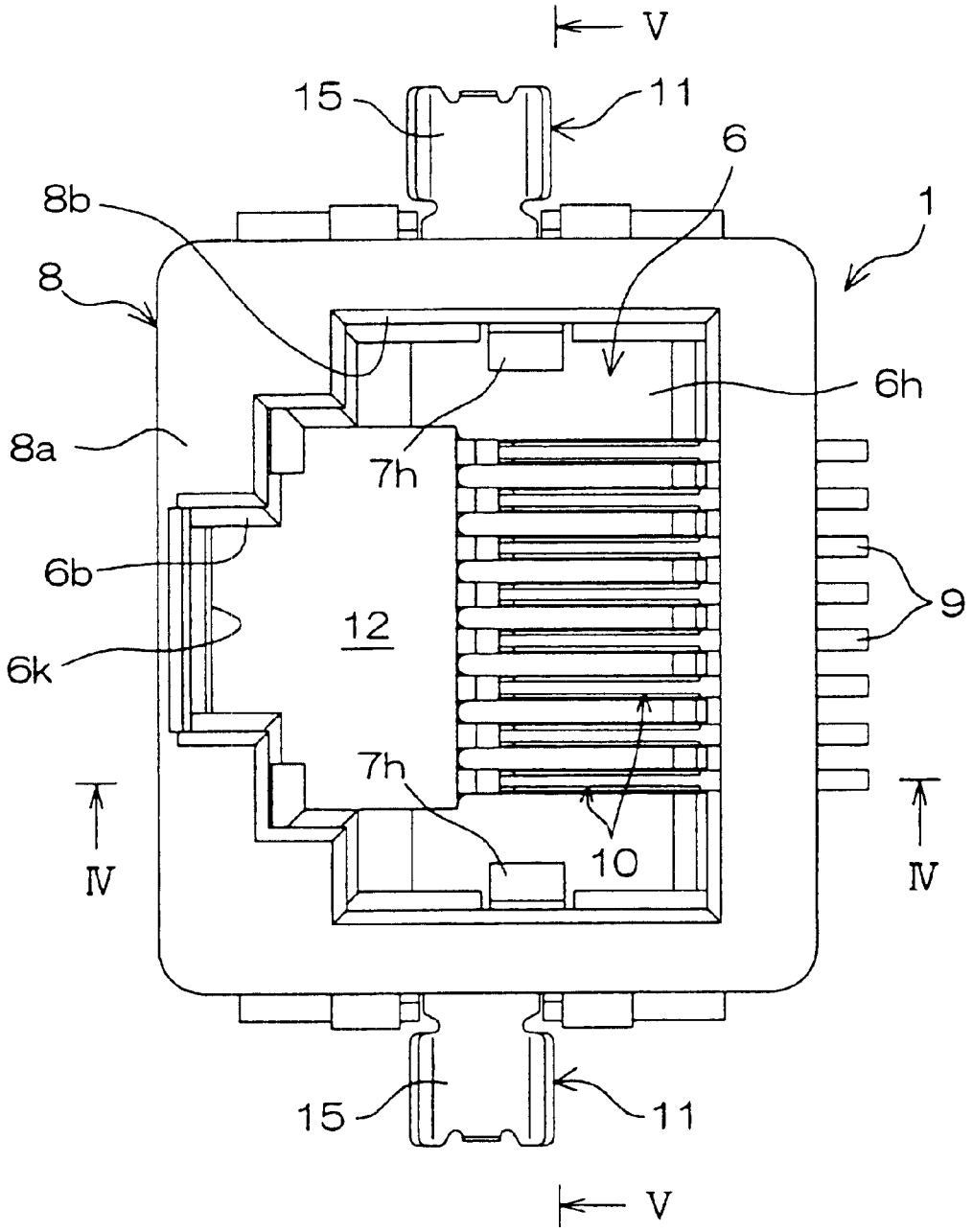
FIG. 3 is a plane view of the modular jack.
Figure 4:
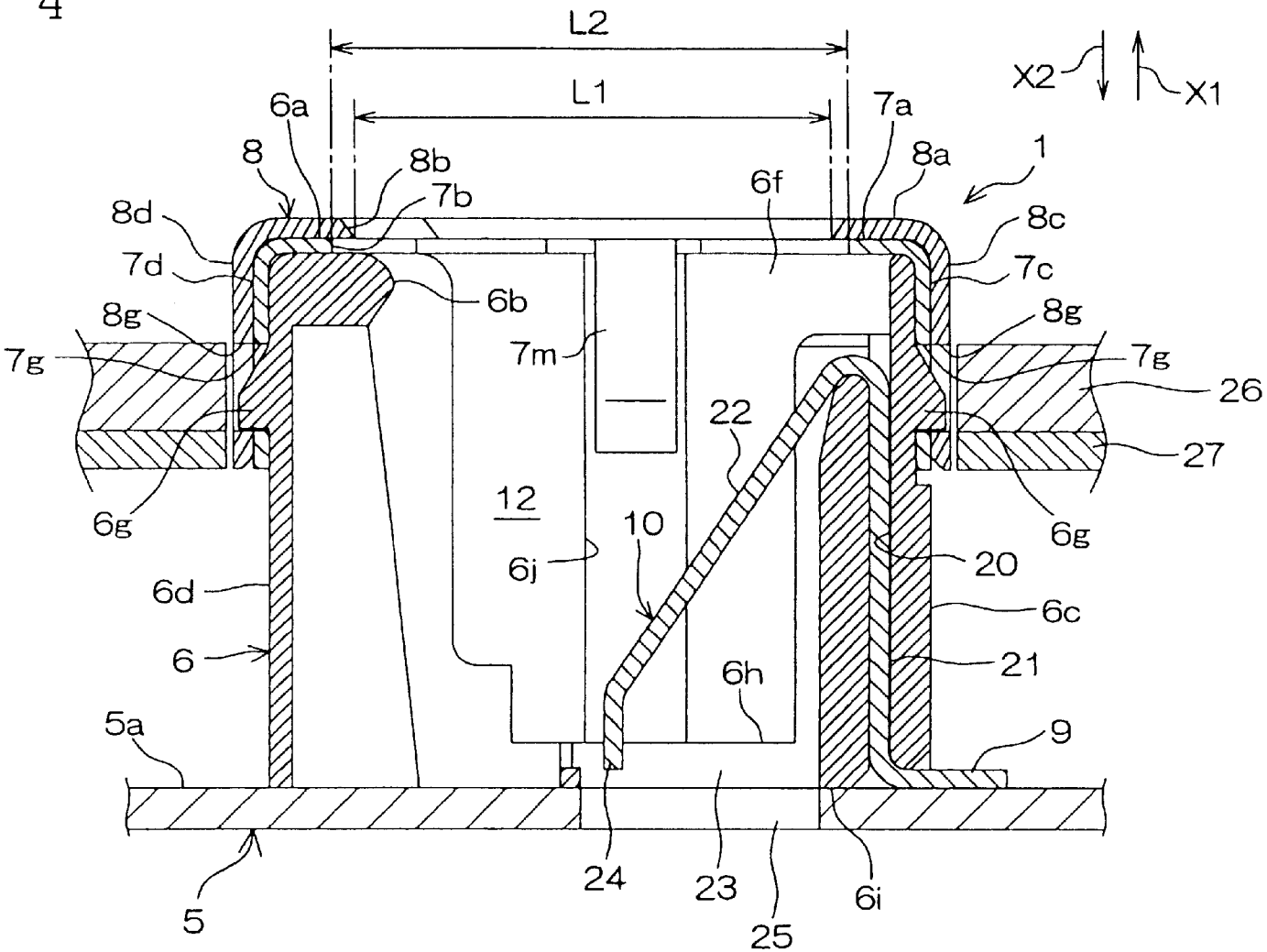
FIG. 4 is a sectional view taken along a line IV—IV of FIG. 3.
Figure 5:
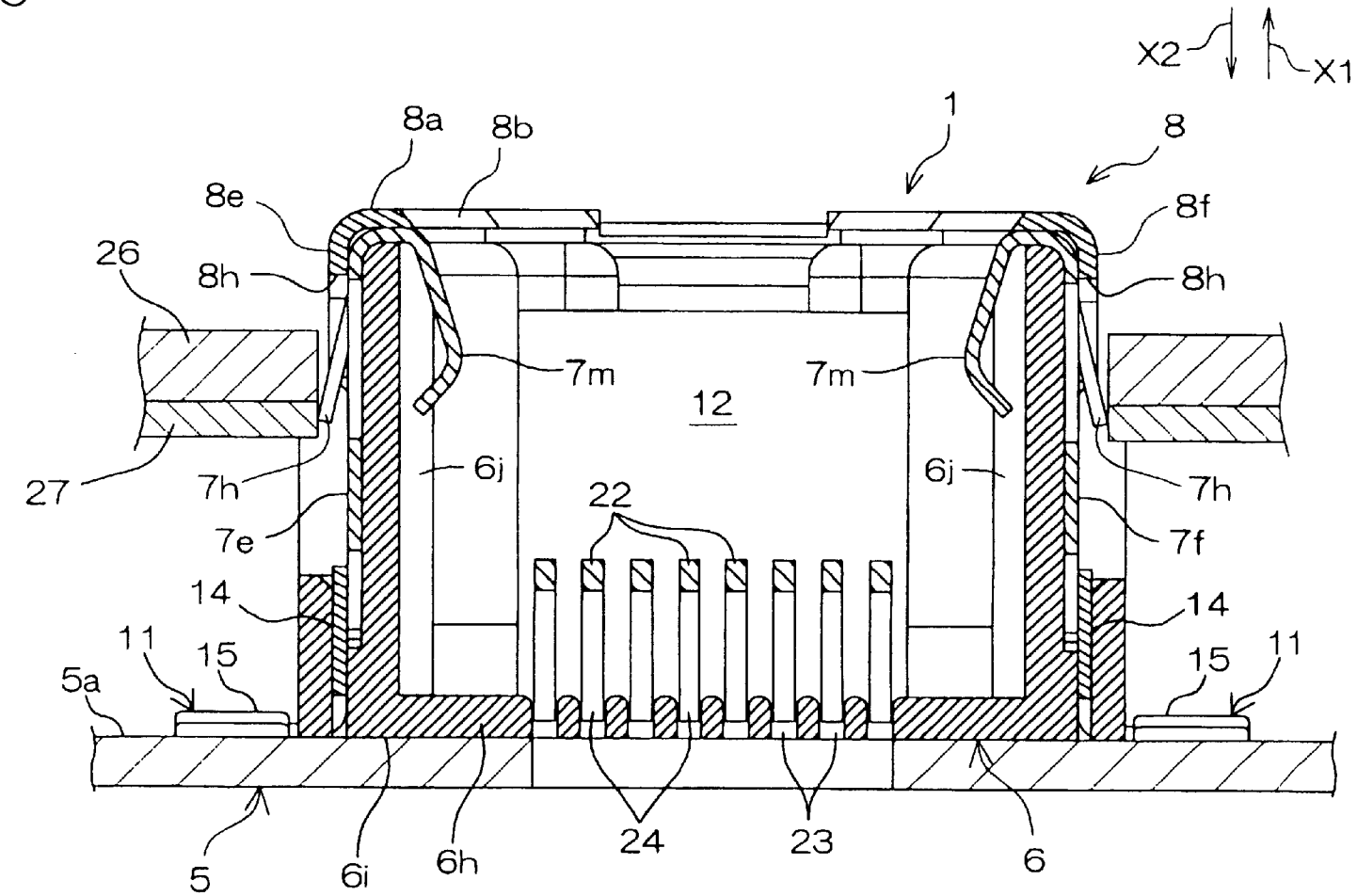
FIG. 5 is a sectional view taken along a line V—V of FIG. 3.
Figure 6:
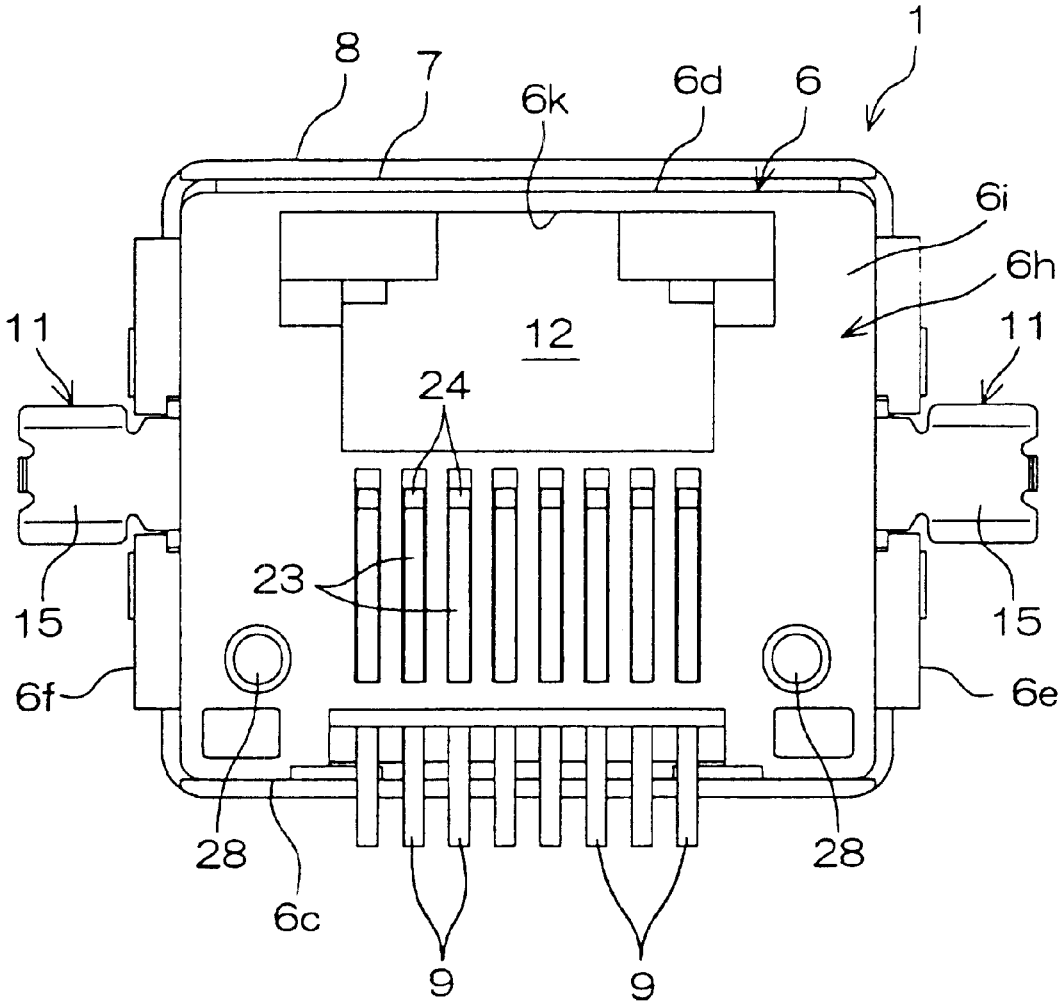
FIG. 6 is a rear view of the modular jack.
Figure 7:
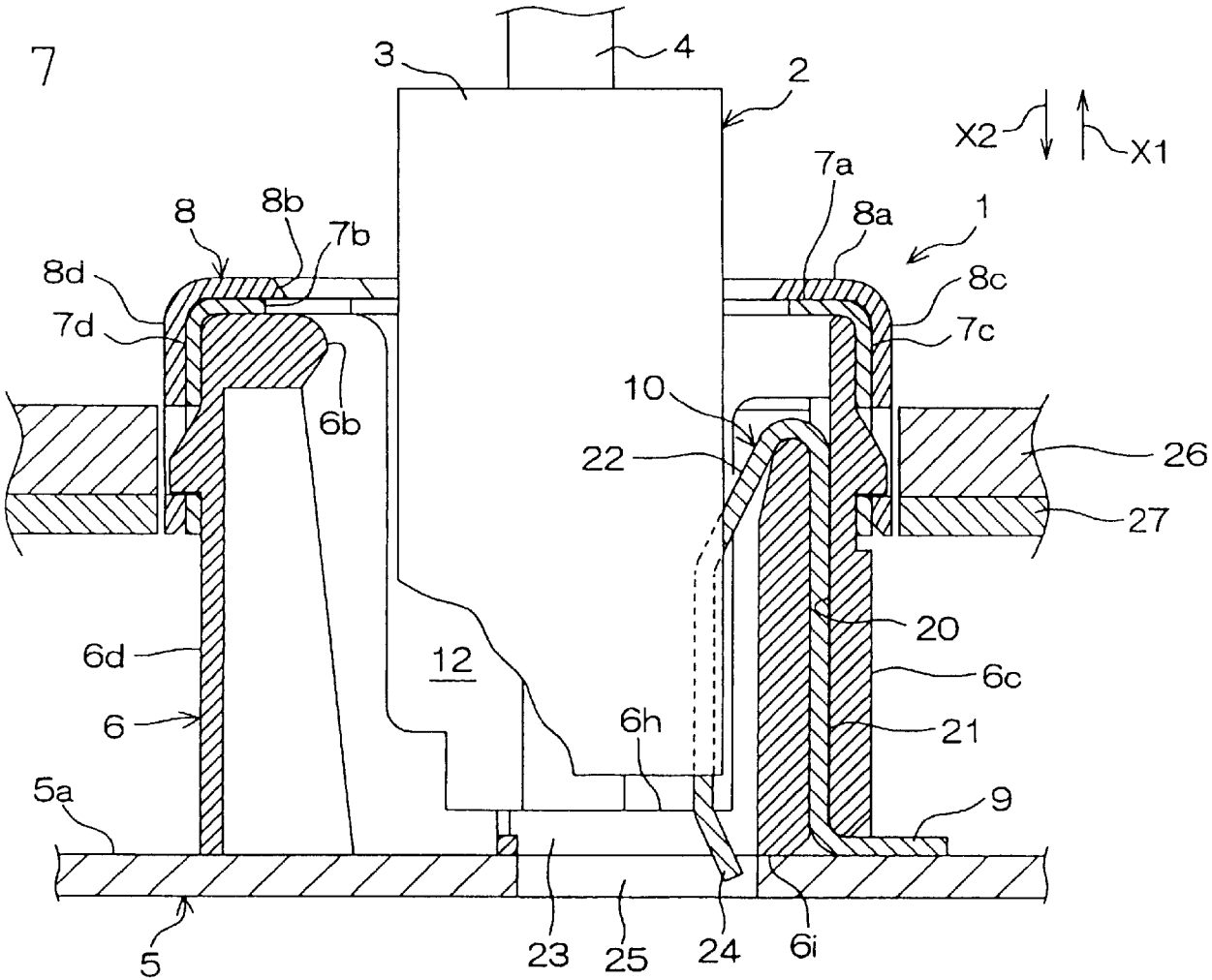
FIG. 7 is an outline sectional view of the modular jack in a state of being connected to the modular plug.

FIG. 2 is a disassembled perspective view of the modular jack, FIG. 3 is a plane view of the modular jack, FIG. 4 is a sectional view taken along a line IV—IV of FIG. 3, FIG. 5 is a sectional view taken along a ling V—V of FIG. 3, and FIG. 6 is a rear view of the modular jack. FIG. 7 is a sectional view of the modular jack in connecting the modular plug.

As shown by FIG. 7, the main characteristics of the embodiment resides in that in connecting the modular plug, a front end 24 of an elastic contact portion 22 of the contact pin 10 is projected rearward from the casing 6 via a slit 23 and that the printed wiring board 5 is formed with a through hole 25 as escapement for permitting the front end 24 to project.

In reference to FIG. 2, FIG. 4 and FIG. 5, the casing 6 is provided with an insertion recessed portion 12 opened in the upper direction X1 via an insertion opening 6*b* formed at a front face 6*a* thereof, and the modular plug 2 is inserted into the insertion recessed portion 12 to thereby connect thereto electrically and mechanically. In reference to FIG. 4 and FIG. 6, a rear face 6*i* of the casing 6 constitutes an attaching face opposed to a surface 5*a* of the printed wiring board 5.

Figure 8:
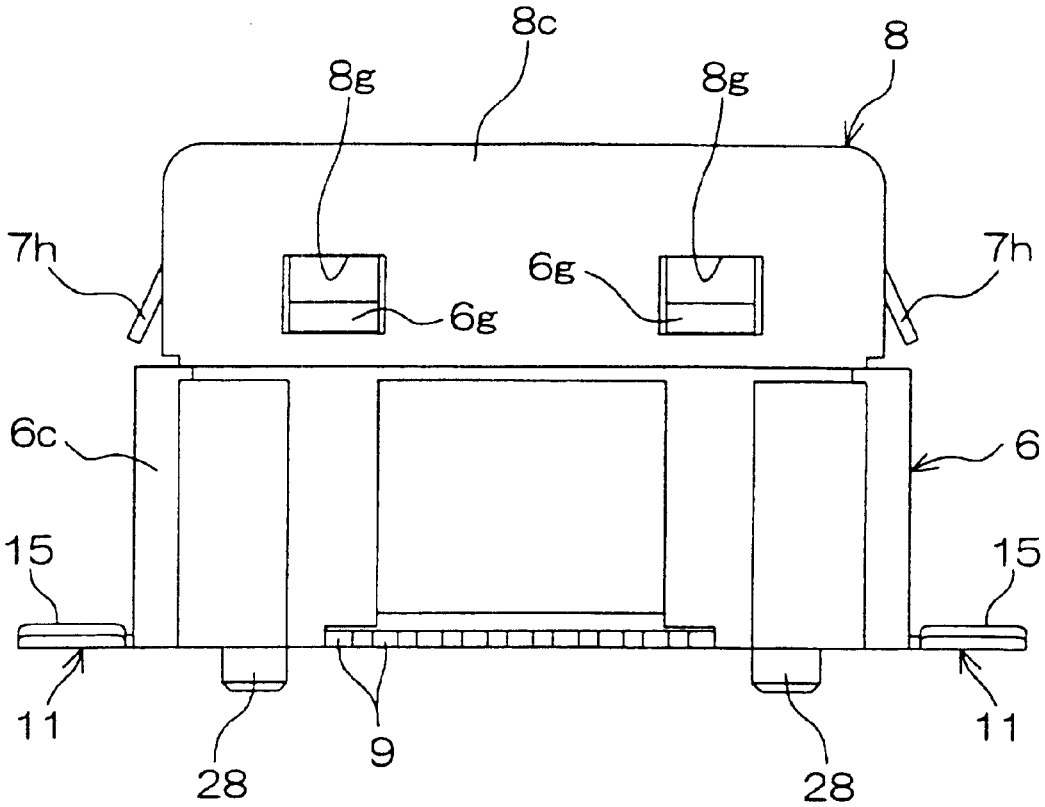
FIG. 8 is a side view of the modular jack.

In reference to FIG. 6, the rear face 6*i* of the case 6 is formed with an opening portion 6*k*. The opening portion 6*k* permits to introduce a base end portion (not illustrated) of the engaging lever 4 of the module plug 2 disposed at a mostly push-in position at inside of the insertion recessed portion 12 of the modular jack 1 to thereby minimize a depth dimension of the modular jack 1 and contribute to low back formation. In reference to FIG. 6 and FIG. 8, numeral 28 designates a rib inserted into an insertion hole (not illustrated) formed at the printed wiring board 5 for positioning the casing 6 to the printed wiring board 5.

In reference to FIG. 2 through FIG. 5, the shell 7 includes a front plate 7*a* having a rectangular contour for covering the front face 6*a* of the casing 6, and the insertion opening 7*b* for the modular plug communicating with the insertion recess portion 12 is partitioned at the front plate 7*a*. Side walls 7*c*, 7*d*, 7*e* and 7*f* respectively provided along corresponding side walls 6*c*, 6*d*, 6*e* and 6*f* of the casing 6, are extended from four sides of the front plate 7*a*. Further, elastic contact pieces 7*m* constituting a mountain shape, are respectively extended from a pair of opposed edge portions of the insertion opening 7*b* toward inside of the insertion recessed portion 12. In reference to FIG. 2 and FIG. 5, guide grooves 6*j* having a long vertical length for guiding the corresponding elastic contact pieces 7*m*, are formed at inner faces of the side walls 6*e* and 6*f* of the casing 6 (In FIG. 2, only the guide groove 6*j* of the side wall 6*f* is shown.). The respective elastic contact pieces 7*m* are for connecting to a metal shell (not illustrated) of the modular plug 2 to thereby connect to the ground. The shell is totally formed of sheet metal.

In reference to FIG. 2 and FIG. 4, left and right pairs of engaging holes 7*g* constituting, for example, a rectangular shape, are formed at the opposed side walls 7*c* and 7*d* of the shell 7. As shown by FIG. 2, the shell 7 is mounted to the casing 6 to cover the casing 6 from the upper side in the lower direction X2 and at this occasion, as shown by FIG. 4, the shell 7 is locked to the casing 6 by engaging locking projections 6*g* formed at the corresponding side walls 6*c* and 6*d* of the casing 6, with the respective engaging holes 7*g*.

In reference to FIG. 2 and FIG. 5, left and right pairs of window portions are formed at the opposed side walls 7*e* and 7*f* of the shell 7, and elastic contact pieces 7*h* are cut to rise in the respective window portions (in FIG. 2, only the elastic contact pieces 7*h* of the side wall 7*e* are shown). As shown by FIG. 5, the elastic contact piece 7*h* is brought into elastic contact with a chassis 27 made of a metal provided along a rear face of a cabinet 26 made of synthetic resin of an apparatus for operating to electrically conduct the shell 7 with the chassis 27 and match the ground level.

In reference to FIG. 1, there are formed first extended portions 7*i* extended from central portions of the respective side walls 7*e* and 7*f* in the lower direction X2 (side of the printed wiring board 5) and there are further formed second extended portions 7*j* extended from central portions of the first extended portions 7*i* in the lower direction X2.

A pair of side portions of the first extended portions 7*i* are respectively fitted to a pair of groove portions 13 formed at the side walls 6*e* and 6*f* of the casing 6 to respectively open in the upward direction X1 and in inward side directions. The second extended portions 7*j* are fitted to groove portions 17 formed between side plates 14 of the corresponding reinforcement tabs 11 and the corresponding side walls 6*e* and 6*f* of the casing 6.

Figure 9:
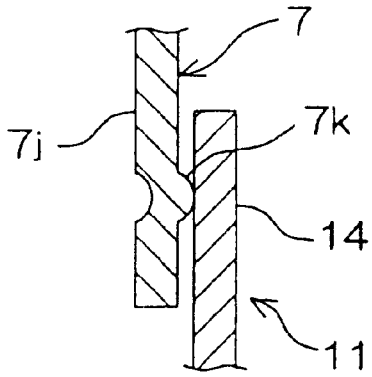
FIG. 9 is a sectional view of a side wall of a shell and a side plate of a reinforcement tab engaged with each other.

In reference to FIG. 1 and FIG. 9, an outer side face of the second extended portion 7*j*, is formed with an engaging projection 7*k* engaged with a back face of the side plate 14 of the reinforcement tab 11.

In reference to FIG. 1, the reinforcement tab 11 is constituted by pressing a conductive sheet metal member and is provided with the side plate 14 and a leg portion 15 in a plate-like shape extended outwardly and orthogonally to a lower end of the side plate 14. Arm portions 16 are extended from upper portions of a pair of side portions of the side plate 14 to both sides, thereby, the side plate 14 is constituted substantially by a T-like shape.

According to the respective reinforcement tabs 11, the side plates 14 are fitted to the pair of groove portions 17 of the corresponding side walls 6*e* and 6*f* by moving the side plates 14 from the upper side in the lower direction X2 along central portions of the side walls 6*e* and 6*f* of the shell 7 previously mounted to the casing 6. At this time, the arm portions 16 of the side plate 14 are brought into contact with positioning stepped portions 18 in the groove portion 17 to thereby position a height position of the reinforcement tab 11. Press-fitting projections 19 are formed at side edges downward from the respective arm portions 16 of the side plate 14. The respective press-fitting projections 19 are press-fitted to corresponding groove walls of the groove portion 17 to thereby lock the side plate 14 from being drawn in the upper direction X1. As shown by FIG. 9, the engaging projection 7*k* of the shell 7 is brought into press contact with the side plate 14 of the reinforcement tab 11 prevented from drawing in this way to thereby ensure to prevent the shell 7 from being drawn in the upward direction.

In reference to FIG. 3 and FIG. 4, the side wall 6*c* holds the plurality of contact pins 10 to align horizontally. Specifically, each of the contact pins 10 is provided with a fixed portion 21 fixedly inserted to a fixing hole 20 penetrating the side wall 6*c* in the up and down direction, an elastic contact portion 22 in a cantilever shape bent to constitute an acute angle from an upper end of the fixed portion 21 and extended in an inclined shape toward the side of the printed wiring board 5 on the lower side and the lead portion 9 bent to constitute substantially right angle from a lower end of the fixed portion 21 and projected to an outer side of the side wall 6*c* along the surface 5*a* of the printed wiring board 5.

Meanwhile, as shown by FIG. 4, FIG. 5 and FIG. 6, at a rear wall 6*h* forming a rear face 6*i* of the casing 6, there are formed a plurality of slits 23 in parallel with each other as lead-out openings for opening the insertion recessed portion 12 to the side of the printed wiring board 5 on the rear side. The slits 23 as the lead-out openings are slidably fitted with front ends 24 of the corresponding elastic contact portions 22.

As shown by FIG. 7, when the modular jack 1 is connected with the modular plug 2 and the respective elastic contact portions 22 are bent, the front ends 24 of the elastic contact portions 22 are projected to the rear side of the casing 6 via the slits 23. The printed wiring board 5 is formed with through holes 25 substantially in a rectangular shape as escapement for permitting the front ends 24 of the plurality of the elastic contact portions 22 to project to the rear side of the casing 6. The slits 23 guide the front ends 24 of the elastic contact portions 22 to smoothly dislocate when the front ends 24 of the elastic contact portions 22 are deformed to bend.

In reference to FIG. 2 through FIG. 5, the insulating cover 8 is provided with a front plate 8*a* having the insertion opening 8*b* and having substantially a rectangular contour and four side walls 8*c*, 8*d*, 8*e* and 8*f* extended from four sides of the front plate 8*a* and constituting a square ring shape.

In reference to FIG. 4, the insertion opening 8*b* of the insulating cover 8 is formed by a similar shape slightly smaller than the insertion opening 7*b* of the shell 7 (opening diameter L1<L2), as a result, the edge portion of the insertion opening 7*b* of the shell 7 is prevented from being exposed by the edge portion of the insertion opening 8*b* of the insulating cover 8.

The respective side walls 8*c* through 8*f* of the insulating cover 8 are made to cover the corresponding side walls 7*c* through 7*f* of the shell 7. Ranges of the respective side walls 8*c* through 8*f* of the insulating cover 8 of covering the corresponding side walls 7*c* through 7*f* of the shell 7, correspond to ranges of exposing the shell 7 from the cabinet 26 of the apparatus in a state in which the modular jack 1 is actually attached to the apparatus as shown by FIG. 4 and FIG. 5. An exposed portion of the shell 7 is covered by the insulating cover 8 and its appearance is excellent. Further, a foreign matter is prevented from being brought into contact with the exposed portion and electromagnetic shielding is ensured.

In reference to FIG. 2 and FIG. 5, the side walls 8*e* and 8*f* are formed with cutout portions 8*h* as escapement for preventing interference with the respective elastic contact pieces 7*h* of the shell 7.

Meanwhile, in reference to FIG. 2 and FIG. 4, the side walls 8*c* and 8*d* are formed with respective pairs of engaging holes 8*g* for engaging with the locking projections 6*g* of the casing 6 projected from the engaging holes 7*g* of the shell 7. By the engagement, there is achieved to prevent the insulating cover 8 from drawing from the shell 7. The locking projections 6*g* of the casing 6 achieve to unitarily lock the shell 7 and the insulating cover 8 to thereby achieve to prevent from being drawn, and the structure can be simplified.

As described above, according to the embodiment, as shown by FIG. 7, in connecting the modular plug 2, the front end 24 of the elastic contact portion 22 of the contact pin 10 can be projected rearward from the casing 6 via the slit 23. Therefore, the moving stroke of the front end 24 of the elastic contact portion 22 in connecting the modular plug 2 can be ensured also at the outside of the casing 6. Therefore, the height of the casing 6 can be lowered by that amount, and a low height of the modular jack 1 can be achieved.

By combining the printed wiring board 5 having the through hole 25 as the escapement capable of permitting the front end 24 to project with the modular jack 1, a low height of the modular jack 1 is substantially enabled.

Further, when the front end 24 of the elastic contact portion 22 is projected to the outside of the casing 6, a vicinity of the front end 24 is guided by the slit 23 and accordingly, the elastic contact portion 22 can smoothly be dislocated.

Figure 10:
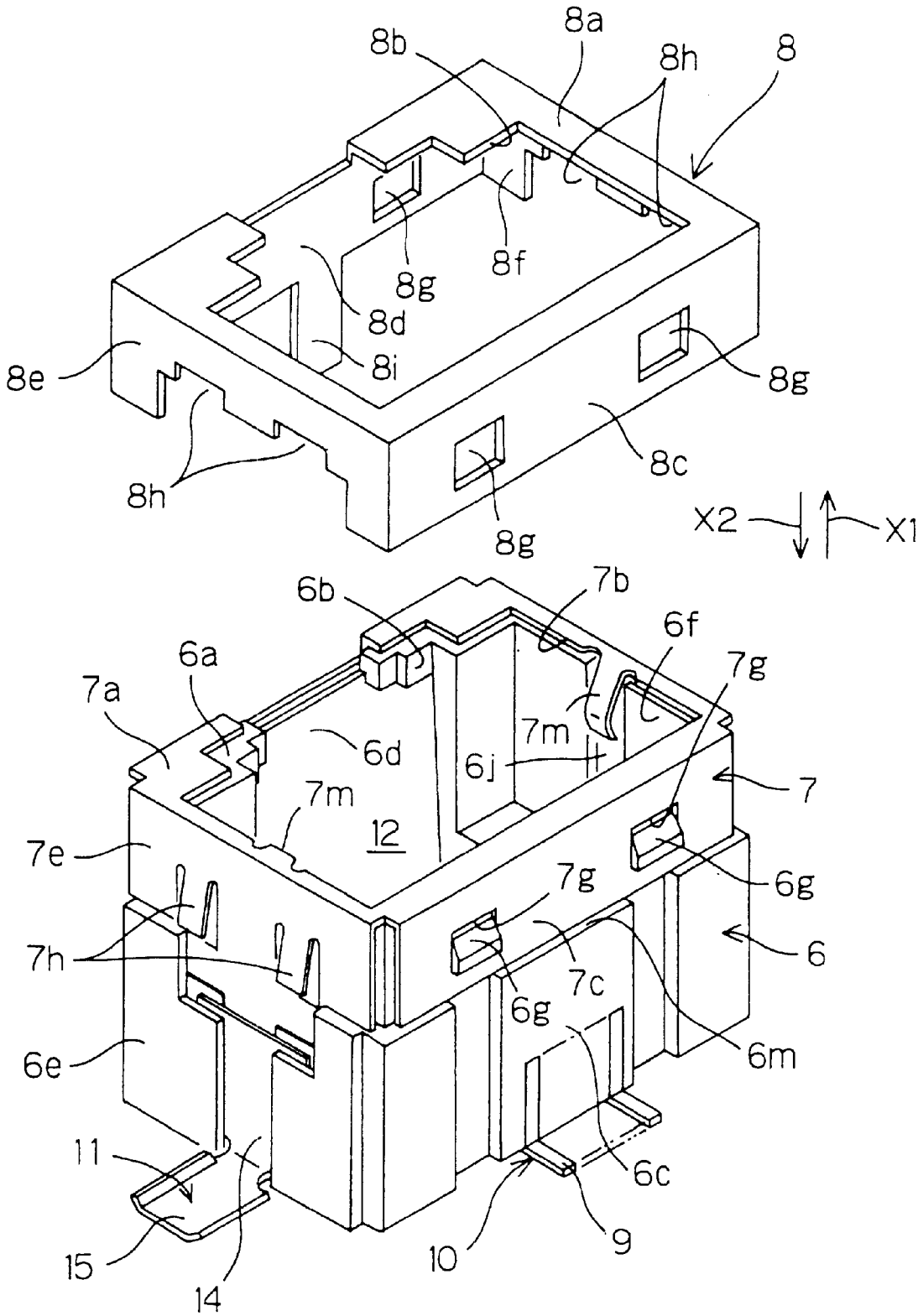
FIG. 10 is a disassembled perspective view of a modular jack according to another embodiment of the invention.

Further, the invention is not limited to the above-described embodiment but, for example, as shown by FIG. 10, an inverse insertion preventive portion 8*i* extended in the lower direction may be extended from the side wall 8*d* of the insulating cover 8. In this case, when the direction of the insulating cover 8 is assumedly changed from a regular direction by 180 degrees and the side wall 8*d* of the insulating cover is going to cover the side wall 7*c* of the shell 7, a lower end of the inverse insertion preventive portion 8*i* is brought into contact with a stepped portion 6*m* of the side wall 6*c* of the casing 6. Thereby, mounting of the insulating cover 8 is hampered and therefore, assembly by so-to-speak inverse insertion cannot be carried out. In the embodiment of FIG. 10, constitutions similar to those of FIG. 2 are attached with similar notations and an explanation thereof is omitted.

Figure 11:
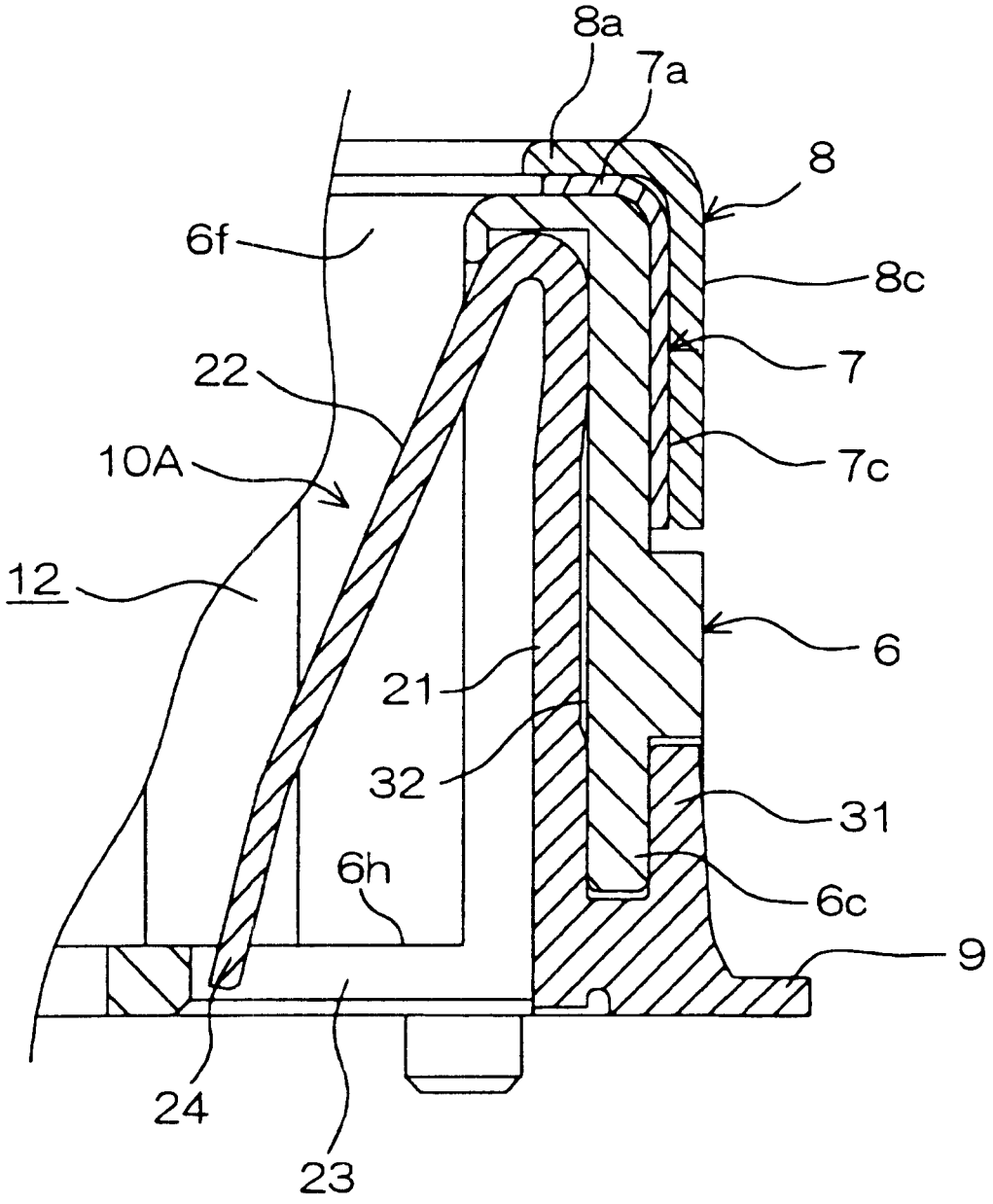
FIG. 11 is a sectional view of a modular jack according to still another embodiment of the invention.

Further, as shown by FIG. 11, there may be constructed a structure in which there is provided an attached piece 31 extended from a lead 9 of a contact pin 10A in parallel with the fixed portion 21 and a lower portion of the side wall 6*c* is sandwiched by the fixed portion 21 and the attached piece 31 to thereby fix the contact pin 10A to the casing 6. Although according to the embodiment of FIG. 4, the fixed portion 21 is inserted into the fixing hole 20 of the casing 6, in this embodiment, the fixed portion 21 is mounted to a holding groove 32 opened to inside of the casing 6 and the lower side of the casing 6. The holding groove 32 communicates with the slit 23. In this embodiment, assembling can easily be carried out by mounting the contact pin 10A from the lower side of the casing 6. That is, the elastic contact portion 22 and the fixed portion 21 of the contact pin 10A are inserted into the casing 6 via the slit 23 and the lower portion of the side wall 6*c* of the casing 6 is press-fitted into a space between the fixed portion 21 and the attached piece 31 to thereby fix thereto. In the embodiment of FIG. 11, constitutions similar to those of the embodiment of FIG. 4 are attached with similar notations.

Figure 12:
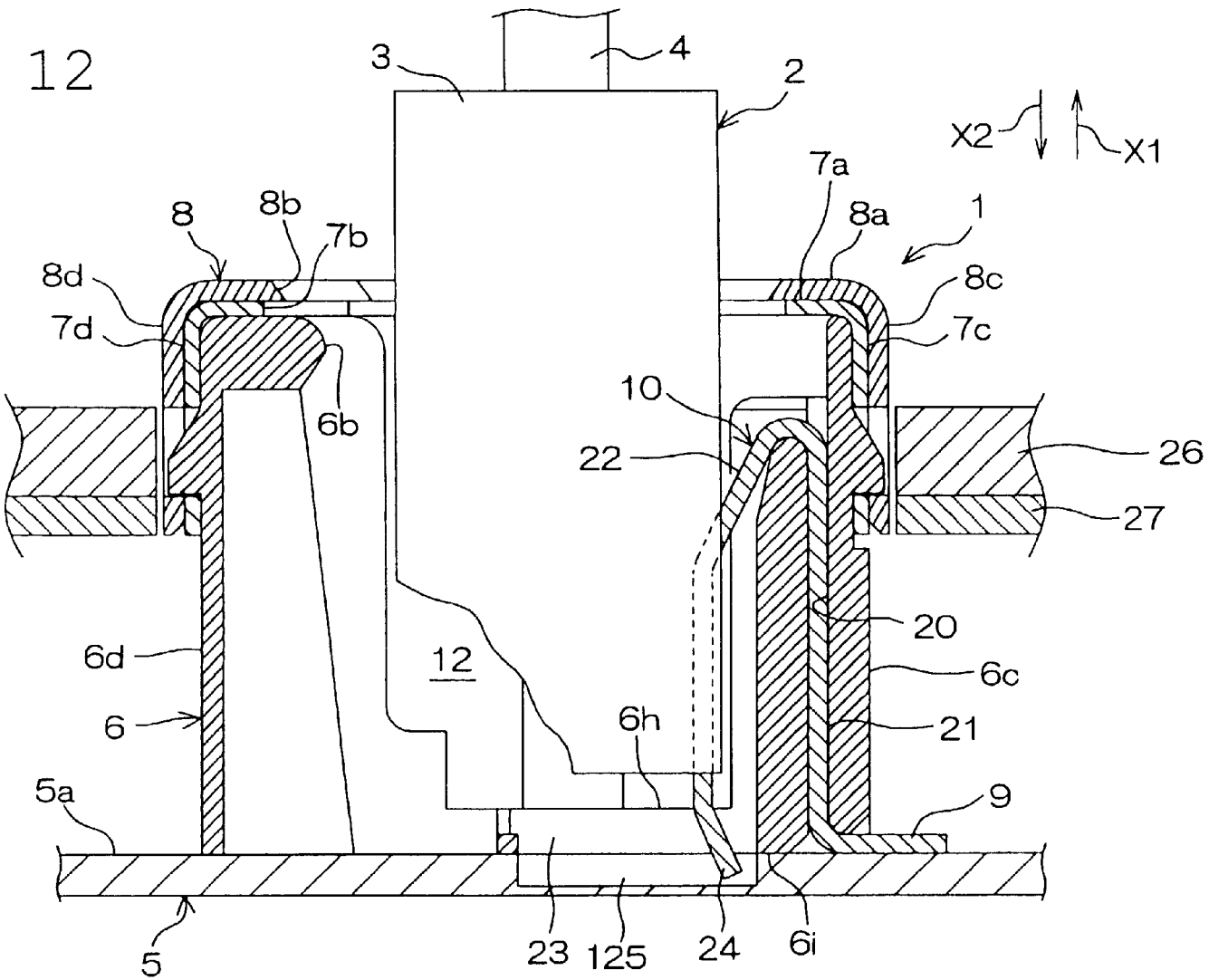
FIG. 12 is an outline sectional view of the modular jack in a state of being connected to the modular plug according to another embodiment of the invention.

Further, as shown in FIG. 12, the escapement provided at the printed wiring board 5 may not necessarily penetrate therethrough but may be a recessed portion 125 formed at the surface 5*a* so far as the recessed portion can permit the front end 24 of the elastic contact portion 22 to project. Otherwise, various changes can be carried out within the range of the invention.

What is claimed is:

1. A modular jack comprising:

an insulated casing having an insertion recessed portion opened in a front direction for inserting a modular plug; and a plurality of contact pins arranged in the insertion recessed portion to align horizontally, wherein each of the contact pins includes a fixed portion for engaging with a side wall of the casing, an elastic contact portion bent to constitute an acute angle from a front end of the fixed portion and extended in an inclined shape toward a rear face of the casing, and an attached piece extended from a lead thereof in parallel with the fixed portion, wherein a lower portion of a side wall of the casing is sandwiched by the fixed portion and the attached piece to thereby fix the contact pin to the casing, and wherein when the casing is connected to the modular plug, a front end of the elastic contact portion pressed by a contact of the modular plug is projected rearward from the casing via a lead-out opening formed at the rear face of the casing.

2. The modular jack according to claim 1, wherein the lead-out opening includes a plurality of slits for guiding the front ends of the elastic contact portions of the respective contact pins in a direction of dislocating the front ends in bending the elastic contact portions.

3. The modular jack according to claim 1, wherein the fixed portion of the contact pin is fixedly inserted into a fixing hole penetrating a side wall of the casing in a front and rear direction.

4. An attaching structure of a modular jack for attaching to a printed wiring board, wherein the modular jack includes:

an insulated casing having an insertion recessed portion opened in a front direction for inserting a modular plug; and a plurality of contact pins arranged in the insertion recessed portion to align horizontally, wherein each of the contact pins includes a fixed portion for engaging with a side wall of the casing and an elastic contact portion bent to constitute an acute angle from a front end of the fixed portion, said elastic contact portion further including a front end parallel to said fixed portion;

wherein when the casing is connected to the modular plug, said front end of the elastic contact portion pressed by a contact of the modular plug is projected rearward toward a rear face of the casing via a lead-out opening formed at the rear face of the casing, and wherein a surface of the printed wiring board is provided with an escapement for permitting the front end of the elastic contact portion to project from the rear face of the casing in a rear direction such that the front end of the elastic contact portion does not protrude from the escapement when the casing is connected to the modular plug.

5. The attaching structure according to claim 4, wherein the lead-out opening includes a plurality of slits for guiding the front ends of the elastic contact portions of the respective contact pins in a direction of dislocating the front ends in bending the elastic contact portions.

6. The attaching structure according to claim 4, the escapement of the printed wiring board is a through hole.

7. The attaching structure according to claim 4, the escapement of the printed wiring board is a recessed portion.

8. An attaching structure of a modular jack for attaching to a printed wiring board, wherein the modular jack includes:

an insulated casing having an insertion recessed portion opened in a front direction for inserting a modular plug; and a plurality of contact pins arranged in the insertion recessed portion to align horizontally, wherein each of the contact pins includes a fixed portion for engaging with a side wall of the casing, an elastic contact portion bent to constitute an acute angle from a front end of the fixed portion and extended in an inclined shape toward a rear face of the casing, and an attached piece extended from a lead thereof in parallel with the fixed portion, wherein a lower portion of a side wall of the casing is sandwiched by the fixed portion and the attached piece to thereby fix the contact pin to the casing, and wherein when the casing is connected to the modular plug, a front end of the elastic contact portion pressed by a contact of the modular plug is projected rearward from the casing via a lead-out opening formed at the rear face of the casing, and wherein a surface of the printed wiring board is provided with an escapement for permitting the front end of the elastic contact portion to project from the rear face of the casing in a rear direction.

9. The attaching structure according to claim 8, wherein the lead-out opening includes a plurality of slits for guiding the front ends of the elastic contact portions of the respective contact pins in a direction of dislocating the front ends in bending the elastic contact portions.

10. The attaching structure according to claim 8, the escapement of the printed wiring board is a through hole.

11. The attaching structure according to claim 8, the escapement of the printed wiring board is a recessed portion.

* * * * *